US008636537B2

(12) United States Patent
Kettern et al.

(10) Patent No.: US 8,636,537 B2
(45) Date of Patent: Jan. 28, 2014

(54) CONNECTING TERMINAL

(75) Inventors: Markus Kettern, Lemgo (DE); Ralf Geske, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 78 days.

(21) Appl. No.: 13/253,086

(22) Filed: Oct. 5, 2011

(65) Prior Publication Data

US 2012/0083152 A1 Apr. 5, 2012

(30) Foreign Application Priority Data

Oct. 6, 2010 (DE) ..... 10 2010 047 458

(51) Int. Cl.
*H01R 4/24* (2006.01)

(52) U.S. Cl.
USPC ..... 439/389

(58) Field of Classification Search
USPC ..... 439/389, 407, 417, 410, 413, 596, 595
See application file for complete search history.

(56) References Cited

U.S. PATENT DOCUMENTS

| | | | | |
|---|---|---|---|---|
| 6,254,421 | B1 | 7/2001 | Denovich et al. | |
| 7,066,764 | B2 * | 6/2006 | Bolouri-Saransar | 439/409 |
| 7,481,666 | B2 * | 1/2009 | Stein | 439/409 |
| 7,794,267 | B2 * | 9/2010 | Daily | 439/409 |
| 7,867,013 | B2 * | 1/2011 | Cox et al. | 439/404 |
| 7,942,689 | B1 * | 5/2011 | Huss et al. | 439/409 |
| 7,985,094 | B2 * | 7/2011 | Dennes et al. | 439/409 |
| 8,062,056 | B2 * | 11/2011 | Lee | 439/395 |

* cited by examiner

*Primary Examiner* — Jean F Duverne
(74) *Attorney, Agent, or Firm* — Leydig, Voit & Mayer, Ltd.

(57) ABSTRACT

A connecting terminal includes a housing having at least one base member and an actuating part coupled to the base member and lockingly engageable therewith in an open position and in a contact position. An insulation-displacement contact is configured to connect a cable. A first latching device is configured to contribute to a first interlocking of the base member and the actuating part in the open position and a second latching device is configured to contribute to a second interlocking of the base member and the actuating part in the contact position.

19 Claims, 2 Drawing Sheets

CONNECTING TERMINAL

CROSS-REFERENCE TO RELATED APPLICATIONS

This application claims priority to German Patent Application No. DE 10 2010 047 458.4, filed Oct. 6, 2010, which is hereby incorporated by reference herein in its entirety.

FIELD

The present invention relates to a connecting terminal having a housing and an insulation-displacement contact for connecting a cable. The housing is composed at least of a base member and of an actuating part that is latchingly engageable therewith.

BACKGROUND

There are a wide array of connecting terminals having an insulation-displacement contact, where a cable is introduced and, upon closing of the housing, the cable is electroconductively contacted by an insulation-displacement contact.

To simplify handling, some housings lock engagingly in the contact position and thereby secure the contact that has been established. Such designs function reliably and allow a reliable operation over the long term. Connecting terminals of this type have the particular disadvantage, however, of requiring one hand to open the housing to establish the contact, for example, and the other hand to subsequently introduce a cable to be connected. This means that a two-handed operation is normally necessary.

U.S. Pat. No. 6,254,421 B1 describes a connecting terminal that is suitably adapted for the contacting of an insulated conductor by an insulation-displacement contact. A lid having a cable guide is pivotably disposed on the housing. Also provided on the housing are two latching arms that cooperate with latching projections configured on the pivotable lid, so that, in the open position, the lid is held in locking engagement on the latching arm. In the closed position, the latching arm locks engagingly on other latching projections of the lid in order to secure the closed contact state.

The system discussed in U.S. Pat. No. 6,254,421 B1 permits easier insertion of a cable to be connected, since the latching arm fixes the housing in place not only in the closed state, but also in the open state. However, it has the inherent disadvantage that a relatively substantial force must be overcome to move the connecting terminal from the latched open state to the latched clamping state. In modern soldering processes, in particular, which include the soldering on of such connecting terminals in a reflow process, high temperatures occur, so that only high-temperature resistant plastics can be used. Such high-temperature resistant plastics are relatively brittle, so that, in the open state of the connecting terminal, there is a considerable risk of the snap-in locking elements breaking off, making the entire component unusable.

SUMMARY

In an embodiment, the present invention provides a connecting terminal including a housing having at least one base member and an actuating part coupled to the base member and lockingly engageable therewith in an open position and in a contact position. An insulation-displacement contact is configured to connect a cable. A first latching device is configured to contribute to a first interlocking of the base member and the actuating part in the open position and a second latching device is configured to contribute to a second interlocking of the base member and the actuating part in the contact position.

BRIEF DESCRIPTION OF THE DRAWINGS

Exemplary embodiments of the present invention are described in more detail below with respect to the drawings, in which.

DETAILED DESCRIPTION

Figure 1:
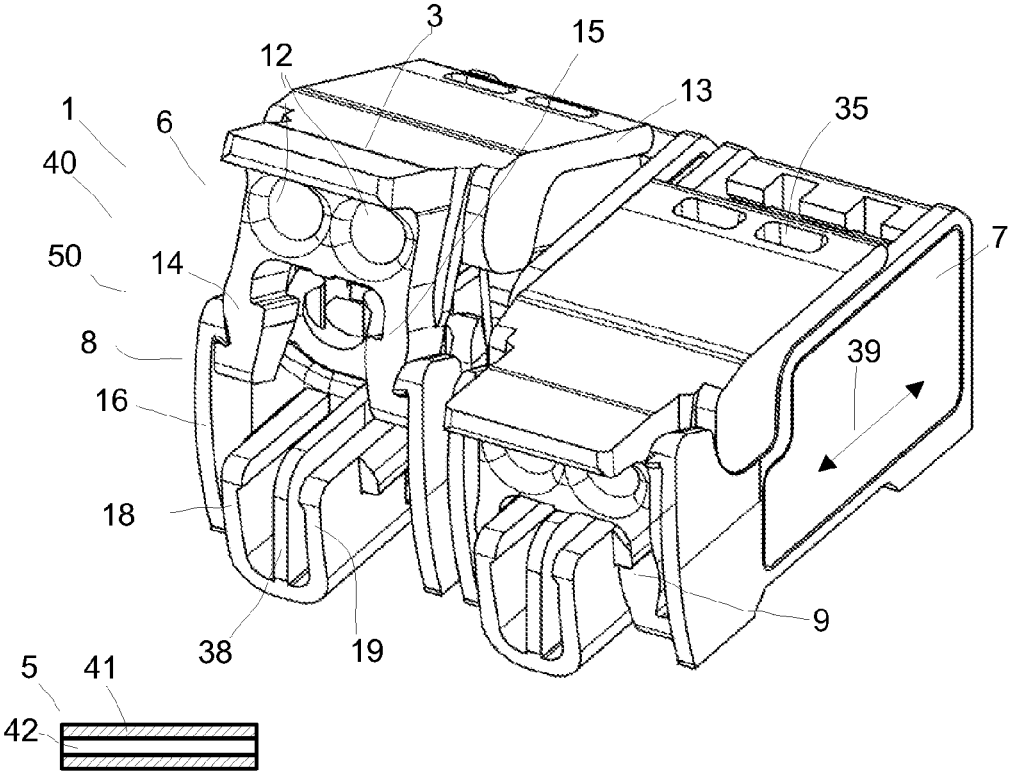
FIG. 1 shows a schematic, perspective view of two connecting terminals.

In an embodiment, the present invention provides a connecting terminal that makes possible a simple and reliable servicing and operation.

The connecting terminal according to an embodiment of the present invention encompasses at least one housing having at least one base member and at least one actuating part that is lockingly engageable therewith. At least one insulation-displacement contact is provided for connecting a cable. The actuating part is provided to be lockingly engageable both in an open position, as well as in a contact position. A first latching device and at least one second latching device are provided. In this context, the first latching device contributes to the interlocking of the base member and the actuating part in the opened state. The second latching device contributes to the interlocking of the base member and the actuating part in the closed state.

In particular, the first latching device causes the base member and the actuating part to lockingly engage with one another in the open state. In particular, the second latching device causes the base member and the actuating part to lockingly engage in the closed state.

Many advantages are associated with the connecting terminal since the first latching device and the second latching device, which is independent thereof, allow the housing to lock engagingly in the open position, as well as in the contact position, respectively. This permits a simple servicing and operation of the connecting terminal. Moreover, the first latching device and the second latching device make it possible for independent latching forces to be provided. This means that the force used to move the actuating part from the open position into the contact position may be selected to be substantially smaller than the force needed for moving the actuating part out of the contact position into the open position again. Due to the fact that both forces may be selected independently of one another since two independent latching devices are provided, the system may be optimally adapted to the material that is used. If the housing is made of a brittle plastic, for example, the force needed to move the actuating part from the open position into the contact position may be selected to be proportionately small to prevent to the greatest degree possible any damage to the actuating part and/or to the base member.

An embodiment of the present invention also makes it possible for the connecting terminal to be able to lock engagingly in the open position and be virtually unable to open further, even in response to the application of substantial forces. In contrast, a relatively small force may be used to move the actuating part from the open position into the contact position. The mutually independent first and second latching devices make it possible for all parameters to be freely selected.

At least one cable guide is preferably provided on an actuating part to ensure a defined transfer of an introduced cable to the insulation-displacement contact.

The insulation-displacement contact makes it possible for a cable having an insulated conductor to be connected.

The actuating part is preferably pivotably accommodated on the base member and is designed, in particular, as a housing lid, so that the housing is virtually closed following the transfer of the actuating part from the open position into the contact position.

It is especially preferred that at least one latching leg be provided on the actuating part and that it project from the actuating part toward the base member. At least two latching legs are preferably provided. Two latching legs render possible a symmetrical and thus an especially secure and reliable connection.

At least one latching arm and at least one latching lever are advantageously provided on the base member.

It is especially preferred that the first latching device have mutually cooperating snap-in locking elements on the latching leg and the latching arm. In particular, at least one snap-in locking element is designed as a detent lug and at least one snap-in locking element as a locking groove. The detent lugs may be provided as snap-in locking elements on the latching leg, while a locking groove may be provided on the latching arm. It is also possible and preferred, however, that a locking groove be provided on the latching leg, and a detent lug on the latching arm.

The locking groove preferably features an acute angle on one side, respectively at one end, and an obtuse angle on the other side, respectively at the other end. The obtuse angle ensures that the force needed to overcome the latching device is relatively minimal. On the other hand, the acute angle has the effect of making the latching action more pronounced in response to increasing force, so that an opening action, that does not destroy the latching device, is not possible without the use of additional auxiliary devices.

Also provided on the second latching device are mutually cooperating snap-in locking elements that are configured on the latching leg and the latching lever. At least one snap-in locking element is designed as a latching member and at least one snap-in locking element as a detent lug. The latching member may be provided on the latching lever and the detent lug on the latching arm. The latching member may also be provided on the latching leg and a detent lug on the latching lever. In any case, the cooperation of the latching member with the detent lug produces a reliable latching of the housing in the contact position. The latching angle used for lockingly engaging the snap-in locking elements may likewise be acute in order to prevent any transfer into the open position, even upon application of greater forces.

The latching member may be designed as a rear grip portion, so that the detent lug cooperating therewith engages latchingly with the rear grip portion and grips the base member or the actuating part from behind.

All of the embodiments can include at least one inspection window on the actuating part. The inspection window is preferably provided at the rear limit stop or in the vicinity of the rear limit stop. Such an inspection window is very advantageous since a simple glance is all that is needed to determine if a cable has been inserted far enough. If the inserted cable is not yet visible through the inspection window, it must be inserted farther, and if it is visible through the window, the actuating part is may be actuated to allow the cable to be contacted by the insulation-displacement contact. For this purpose, the distance from the inspection window to the insulation-displacement contact should be dimensioned in such a way that a cable visible through the inspection window is indicative of a reliable contact on the insulation-displacement contact being possible.

In embodiments of the invention, it is especially preferred that the base member and/or the actuating part be at least partially made of a high-temperature resistant plastic. Such an embodiment permits a reliable use of such connecting terminals and the preassembly thereof on circuit boards and the like, even when a reflow soldering process is used. High-temperature resistant plastics are not transparent, so that an inspection window makes it possible for an inserted cable to be controlled.

Two latching arms having an upwardly tapered spacing therebetween are preferably provided symmetrically on the base member. This means that, even when working with closely side-by-side configured connecting terminals, the latching arms are able to swivel apart in the area of the detent lugs in order to overcome a lockingly engaged state.

Two latching levers are preferably provided which, in particular, are symmetrically configured at a central region of the base member. A tool may be used, for example, to elastically deform the latching levers in order to override the latched state of the second latching device in the contact position and reopen the housing.

In the contact position, it is especially preferred that the two latching levers be provided between the two latching legs. In the contact position, the two latching legs are configured between the two latching arms. A simple and compact design is thereby created that permits a reliable function in the context of a minimal number of service personnel.

For the opening procedure, the two latching levers may be pressed against each other and, in order to prevent overstressing or excessive deformation of the latching levers, a supporting wall may be provided between the two latching levers to provide a defined limit stop when a tool is used for the opening procedure. The supporting wall restricts any potential deformation of the latching levers, thus ensuring reliable operation of the connecting terminal over the long term. In such an embodiment, the two latching levers having the supporting wall provided therebetween have an approximately W-shaped structure.

It is especially preferred that the two latching levers be forwardly projecting. This allows an operator to use a tool, such as pincers, to easily grasp the latching levers in order to press them together and thereby overcome the latching action of the second latching device. Subsequently thereto, the actuating part may be pivoted upwards, thereby re-releasing the contacted cable.

In some instances, a manual operation may also be optionally used to adjust the housing.

Connecting terminals having two cable terminals are often made available where two insulation-displacement contacts are then provided for contacting the two cables to be connected. To ensure the requisite safety distances between the insulation-displacement contacts, they are configured so as to be mutually offset, in particular in the longitudinal direction of the housing. Thus, the distance from the insulation-displacement contacts to the creepage path is increased, so that, in spite of a plurality of parallel cables, the air clearance and creepage distances are not unacceptably diminished.

Figure 2:
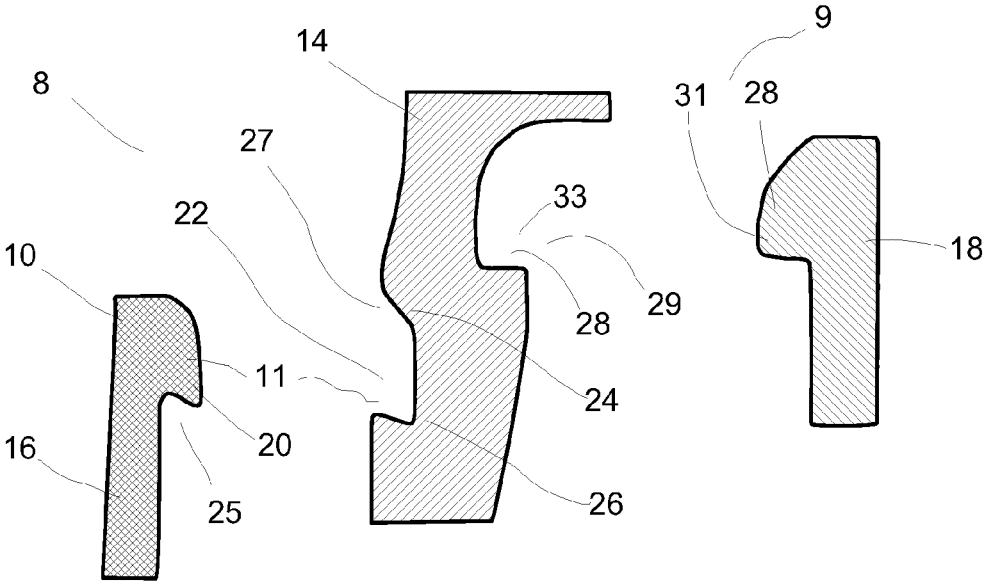
FIG. 2 shows the cross sections of a latching arm, a latching lever and a latching leg.
Figure 3:
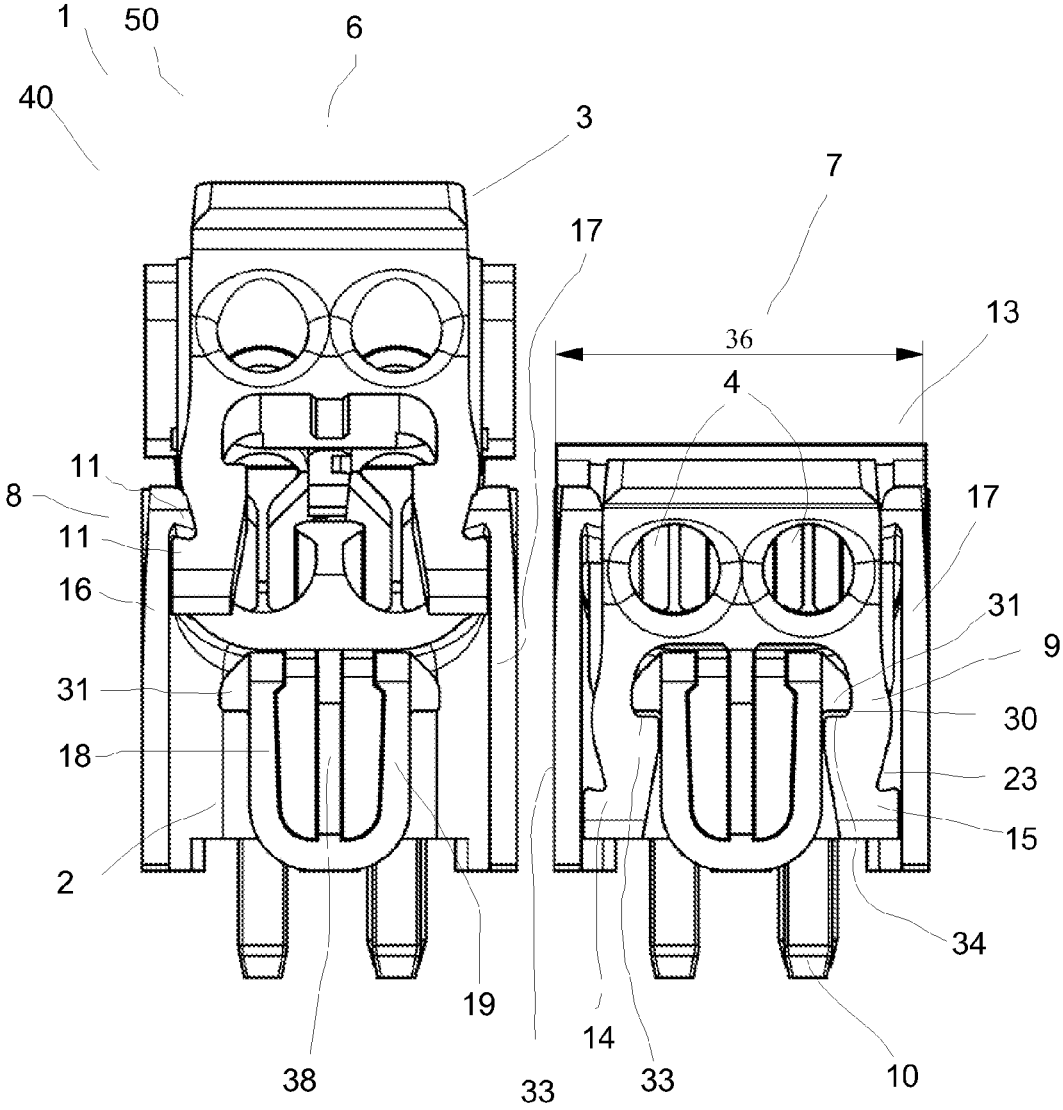
FIG. 3 shows a front view of the two connecting terminals in accordance with FIG. 1.

An exemplary embodiment of the present invention is clarified with reference to FIGS. 1-3. FIG. 1 shows a perspective view of two connecting terminals 50 designed as printed-circuit terminals 40. In each case, connecting terminal 50 has a housing 1 that is composed in the exemplary embodiment of a base member 2 and an actuating part 3. Actuating part 3 is accommodated in a swivel mount at the rear end of base member 2. The two printed-circuit terminals 40 are identical in design.

Two cable guides 12 are provided here on actuating part 3 for connecting two cables 5. The diameter of the cable guides is adapted to the diameter of cables 5 to be connected.

Connecting terminal 50 has insulation-displacement contacts 4 for contacting cables 5 to be connected. Upon contacting, insulation-displacement contacts 4 cut through insulation 41 of cable 5 and come thereby into contact with conductor 42 via the individual conductor cores thereof.

Connecting terminal 50 is illustrated on the left in FIG. 1 in open position 6, while connecting terminal 50 drawn further to the right is shown in contact position 7.

A first latching device 8 ensures a secure locking engagement of housing 1 in open position 6. In this open position 6, latching legs 14 and 15 interlock with latching arms 16 and 17 of base member 2 and prevent any further opening of the housing and, moreover, ensure that the housing is able to be moved again by a relatively small force from open position 6 into contact position 7.

At least one inspection window 35 is provided in housing lid 13 at the rear end of housing 1 to make it possible to determine if a cable 5 to be connected has been inserted far enough. If cable 5 has not yet been inserted far enough and is not visible in inspection window 35, it must then be introduced farther along longitudinal direction 39 of connecting terminal 50.

In a schematized view, FIG. 2 shows snap-in locking elements 11 and 28 of first and second latching devices 8 and 9. A latching leg 14, which is connected to actuating part 3, is illustrated in the middle of the figure. Left therefrom, a snap-in locking element designed as detent lug 20 is depicted at the end of latching arm 16. Formed on snap-in locking element 11 designed as detent lug 20 is an acute angle 25 within a 70° to 80° range, for example, that ensures a reliable and fixed locking engagement of housing 1 in open position 6.

Detent lug 20 of latching arm 16 is provided for cooperating with locking groove 22 of latching leg 14. Locking groove 22 serves as snap-in locking element 11. At first end 24 located further above, locking groove 22 features an obtuse angle 27 of between 100 and 130°. On the other hand, an acute angle 25 is provided at the other deeper end 26 that, in particular, cooperates with acute angle 25 at detent lug 20 of latching arm 16.

Together with detent lug 20 at latching arm 16, locking groove 22 constitutes first latching device 8.

Second latching device 9, which is independent thereof, is formed by rear grip portion 34 on latching leg 14 and by detent lug 31 on latching lever 18.

FIG. 3 shows a front view of the two connecting terminals 50 in accordance with FIG. 1 in open position 6 for left connecting terminal 60 and in contact position 7 for right connecting terminal 50.

It is clearly discernible that, in open position 6, snap-in locking element 11, which is formed as detent lug 20, of latching arm 16 cooperates with snap-in locking element 11, formed as locking groove 22, of spring leg 14. The provision of acute angle 25 at snap-in locking elements 11 of first latching device 8 reliably prevents connecting terminal 50 from opening too far. Obtuse angle 27 at the other end of locking groove 22 allows actuating part 3 to move from open position 6 into contact position 7 in response to a relatively small force. During the transfer, latching arms 16 and 17 deflect resiliently elastically outwardly. This is also made possible when working with closely side-by-side configured connecting terminals 50, since latching arms 16 and 17 converge slightly, making possible an elastic resilience.

Second latching device 9 locks engagingly in contact position 7, snap-in locking elements 28 of first and second latching leg 14 and 15 interlocking with latching members 29 and 30 of base member 2. Latching members 29 and 30 are designed here as rear grip portions 33 and 34, so that snap-in locking elements 28 of the second latching device, which are designed as detent lugs 31 and 32, engage on rear grip portions 33 and 34 and thereby latch second latching device 9.

In principle, any given latching angle of snap-in locking elements 28 is possible. The angle is preferably selected in a way that makes an unintentional opening impossible.

To open and move connecting terminal 50 from contact position 7 into open position 6, a tool may be used to press latching levers 18 and 19 of second latching device 9 so far together until they engage on supporting wall 38 therebetween. This makes it possible to brace latching levers 18 and 19 and, moreover, to avoid an excessive deformation that could lead to breakage of the latching levers.

Readily apparent in each instance on housing 1 are solder pins 10, which are used to join connecting terminal 50 to a circuit board, for example.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS housing 1
base member 2
actuating part 3
insulation-displacement contact 4
cable 5
open position 6
contact position 7
first latching device 8
second latching device 9
solder pin 10
snap-in locking element 11
cable guide 12
housing lid 13
latching leg 14, 15
latching arm 16, 17
latching lever 18, 19
detent lug 20, 21
locking groove 22, 23
one side 24
acute angle 25
other side 26
obtuse angle 27
snap-in locking element 28
latching member 29, 30
detent lug 31, 32
rear grip portion 33, 34
inspection window 35
distance 36
central region 37
supporting wall 38
longitudinal direction 39
printed-circuit terminal 40
insulation 41
conductor 42
connecting terminal 50

What is claimed is:

1. A connecting terminal comprising:

a housing including at least one base member and an actuating part coupled to the base member and lockingly engageable therewith in an open position and in a contact position; and an insulation-displacement contact configured to connect a cable;

wherein a first latching device includes a first pair of mutually cooperating snap-in locking elements respectively disposed on the at least one base member and actuating part, the first latching device being configured to contribute to a first interlocking of the base member and the actuating part in the open position; and wherein a second latching device includes a second pair of mutually cooperating snap-in locking elements respectively disposed on the at least one base member and actuating part, the second latching device being configured to contribute to a second interlocking of the base member and the actuating part in the contact position.

2. The connecting terminal as recited in claim 1, wherein the actuating part includes at least one cable guide.

3. The connecting terminal as recited in claim 1, wherein the actuating part is pivotable with respect to the base member.

4. The connecting terminal as recited in claim 3, wherein the actuating part includes a housing lid of the housing.

5. The connecting terminal as recited in claim 1, wherein the actuating part includes at least one latching leg that projects toward the base member.

6. The connecting terminal as recited in claim 1, wherein the base member includes at least one latching arm and at least one latching lever.

7. The connecting terminal as recited in claim 1, wherein the first pair of mutually cooperating snap-in locking elements are respectively disposed on a latching leg of the actuating part and a latching arm of the base member, at least one of the snap-in looking elements including a detent lug, and at least one of the snap-in locking elements including a locking groove.

8. The connecting terminal as recited in claim 7, wherein the locking groove has an acute angle on a first side and an obtuse angle on a second side.

9. The connecting terminal as recited in claim 1, wherein the second pair of mutually cooperating snap-in locking elements are respectively disposed on a latching leg of the actuating part and a latching lever of the base member, at least one of the snap-in locking elements including a detent lug, and at least one of the snap-in locking elements including a locking groove.

10. The connecting terminal as recited in claim 1, wherein at least one of the first latching device and the second latching device includes a latching member having a rear grip portion.

11. The connecting terminal as recited in claim 1, wherein the actuating part includes an inspection window.

12. The connecting terminal as recited in claim 1, wherein at least one of the base member and the actuating part include a high-temperature resistant plastic.

13. The connecting terminal as recited in claim 1, wherein the has member includes two symmetrical latching arms having an upwardly tapered spacing.

14. The connecting terminal as recited in claim 1, wherein the base member includes two latching levers symmetrically disposed in a central region of the base member and a supporting wall disposed between the two latching levers.

15. The connecting terminal as recited in claim 1, further comprising another insulation displacement contact for connecting a second cable, the other insulation displacement contact being disposed at a mutually offset location from the insulation displacement contact in a longitudinal direction.

16. A connecting terminal comprising:

a housing including at least one base member and an actuating part coupled to the base member and lockingly engageable therewith in an open position and in a contact position; and an insulation-displacement contact configured to connect cable;

wherein a first latching device is configured to contribute to a first interlocking of the base member and the actuating part in the open position; and wherein a second latching device is configured to contribute to a second interlocking of the base member and the actuating part in the contact position, wherein the actuating part includes two latching legs projecting toward the base member, and the base member includes two latching arms and two latching levers, wherein in a closed state the two latching levers are disposed between the two latching legs and the two latching legs are disposed between the two latching arms.

17. The connecting terminal as recited in claim 16, wherein the two latching levers are configured to be pressed against each other so as to open the second latching device.

18. The connecting terminal as recited in claim 16, wherein a supporting wall is disposed between the two latching levers, and wherein the two latching levers are configured to be pressed against the supporting wail so as to open the second latching device.

19. The connecting terminal as recited in claim 16, wherein the two latching levers project forwardly.

* * * * *